US010641104B2

(12) United States Patent
Pott

(10) Patent No.: US 10,641,104 B2
(45) Date of Patent: May 5, 2020

(54) TRAILING EDGE EJECTION COOLING

(71) Applicant: ROLLS-ROYCE plc, London (GB)

(72) Inventor: Joshua J. Pott, Bristol (GB)

(73) Assignee: ROLLS-ROYCE PLC, London (GB)

( * ) Notice: Subject to any disclaimer, the term of this patent is extended or adjusted under 35 U.S.C. 154(b) by 190 days.

(21) Appl. No.: 15/622,375

(22) Filed: Jun. 14, 2017

(65) Prior Publication Data

US 2017/0362942 A1 Dec. 21, 2017

(30) Foreign Application Priority Data

Jun. 21, 2016 (GB) ..... 1610783.1

(51) Int. Cl.
*F01D 5/18* (2006.01)
*F01D 5/14* (2006.01)

(52) U.S. Cl.
CPC ..... *F01D 5/187* (2013.01); *F01D 5/14* (2013.01); *F01D 5/18* (2013.01); *F01D 5/186* (2013.01); *F05D 2220/32* (2013.01); *F05D 2230/10* (2013.01); *F05D 2230/13* (2013.01); *F05D 2230/90* (2013.01); *F05D 2240/122* (2013.01);
(Continued)

(58) Field of Classification Search
CPC ... F01D 5/187; F01D 5/18; F01D 5/14; F01D 5/186; F05D 2260/20; F05D 2240/122; F05D 2230/90; F05D 2230/13; F05D 2230/10; F05D 2220/32; F05D 2240/304
See application file for complete search history.

(56) References Cited

U.S. PATENT DOCUMENTS 4,229,140 A * 10/1980 Scott ..... F01D 5/141 415/115
5,458,461 A 10/1995 Lee et al.
(Continued)

FOREIGN PATENT DOCUMENTS

EP 0034961 9/1981
EP 1288436 3/2003
(Continued)

OTHER PUBLICATIONS

European Search Report dated Nov. 6, 2017, issued in EP Patent Application No. 17172211.
(Continued)

*Primary Examiner* — Joseph J Dallo
*Assistant Examiner* — Kurt Philip Liethen
(74) *Attorney, Agent, or Firm* — Oliff PLC

(57) ABSTRACT

A hollow aerofoil is described having a leading edge and a trailing edge. The leading edge and trailing edge are connected by a pressure surface side (34) and a suction surface side (37) and one or more cavities are bounded by the pressure surface side (34) and/or suction surface side (37). In use, the cavity is arranged to receive coolant from a coolant source. The trailing edge has an apogee (36) where the pressure surface side (34) and suction surface side (37) meet. In an embodiment, a row of holes (32) is provided to a pressure surface side of a centreline of the apogee (36), the holes (32) being in fluid communication with cavity. The arrangement of the holes is such that outlets (33) to the holes extend from the apogee (36) and onto an adjacent part of the pressure surface side (34). A method for the manufacture of the aerofoil is also described.

16 Claims, 6 Drawing Sheets

(52) U.S. Cl.
CPC .... *F05D 2240/304* (2013.01); *F05D 2260/20* (2013.01)

(56) References Cited

U.S. PATENT DOCUMENTS

| | | | | |
|---|---|---|---|---|
| 5,503,529 | A | 4/1996 | Anselmi et al. | |
| 5,893,984 | A | 4/1999 | Thompson | |
| 7,950,903 | B1 | 5/2011 | Liang | |
| 7,980,821 | B1 | 7/2011 | Liang | |
| 8,770,920 | B2 | 7/2014 | Naik et al. | |
| 2004/0151586 | A1* | 8/2004 | Chlus | F01D 5/187 416/97 R |
| 2006/0219379 | A1* | 10/2006 | Prigent | B22C 9/10 164/28 |
| 2007/0261811 | A1* | 11/2007 | Guerche | B22C 9/103 164/28 |
| 2008/0031738 | A1* | 2/2008 | Lee | F01D 5/18 416/97 R |
| 2014/0147287 | A1 | 5/2014 | Xu | |
| 2014/0373503 | A1* | 12/2014 | Hanlon | G05B 19/401 60/39.01 |
| 2015/0285080 | A1* | 10/2015 | Huebner | F01D 5/141 416/223 A |
| 2017/0151604 | A1* | 6/2017 | Digard Brou De Cuissart | B22C 1/00 |
| 2018/0252231 | A1* | 9/2018 | Northall | F01D 9/041 |

FOREIGN PATENT DOCUMENTS

| | | |
|---|---|---|
| EP | 1496204 | 1/2005 |
| EP | 2236752 | 10/2010 |
| GB | 1560683 | 2/1980 |
| WO | 0143912 | 6/2001 |

OTHER PUBLICATIONS

Great Britain Search Report dated Oct. 26, 2016, issued in GB Patent Application No. 1610783.1.

* cited by examiner

TRAILING EDGE EJECTION COOLING

CROSS-REFERENCE TO RELATED APPLICATIONS

This application is based upon and claims the benefit of priority from British Patent Application Number 1610783.1 filed 21 Jun. 2016, the entire contents of which are incorporated by reference.

FIELD OF DISCLOSURE

The present disclosure is concerned with the cooling of aerofoils. For example (but without limitation) the cooling of aerofoil shaped blades and vanes arranged downstream of a combustor in a gas turbine engine.

BACKGROUND

In a gas turbine engine, ambient air is drawn into a compressor section. Alternate rows of stationary and rotating aerofoil blades are arranged around a common axis; together these accelerate and compress the incoming air. A rotating shaft drives the rotating blades. Compressed air is delivered to a combustor section where it is mixed with fuel and ignited. Ignition causes rapid expansion of the fuel/air mix which is directed in part to propel a body carrying the engine and in another part to drive rotation of a series of turbines arranged downstream of the combustor. The turbines share rotor shafts in common with the rotating blades of the compressor and work, through the shaft, to drive rotation of the compressor blades.

It is well known that the operating efficiency of a gas turbine engine is improved by increasing the operating temperature. The ability to optimise efficiency through increased temperatures is restricted by changes in behaviour of materials used in the engine components at elevated temperatures which, amongst other things, can impact upon the mechanical strength of the blades and a rotor disc which carries the blades. This problem is addressed by providing a flow of coolant through and/or over the turbine discs and blades.

It is known to take off a portion of the air output from the compressor (which is not subjected to ignition in the combustor and so is relatively cooler) and feed this to surfaces in the turbine section which are likely to suffer damage from excessive heat.

Typically the cooling air is delivered adjacent the rim of the turbine disc and directed to a port which enters the turbine blade body and is distributed through the blade, typically by means of a labyrinth of channels extending through the blade body.

Turbine blades are known to be manufactured by casting methods. A mould defines an external geometry of the turbine and a core is inserted into the mould to define the internal geometry, molten material (typically a ferrous or non-ferrous alloy) is then cast between the mould and the core and the core subsequently is removed, for example by leaching.

To cool the trailing edge of an aerofoil, holes are positioned as far downstream (with respect to the direction of working fluid flow) as possible. This also reduces the required flow as the pressure margin between the internal and external is lowest at the trailing edge, this improves cooling flow efficiency. Desirably, holes would be located along the apogee of the trailing edge; however, this would require an increased thickness at the apogee which could result in deterioration in aerodynamic efficiency. Since aerofoils for use in gas turbine engines have typically been manufactured by investment casting, it has been difficult to control the consistency of thickness along the apogee of the trailing edge.

It is known to use a system known as Pressure Side Ejection (PSE) to cool the trailing edge of a turbine blade. In such systems, holes are drilled into a cast aerofoil near the apogee but on the pressure surface side. Electrical Discharge Machining (EDM) is known to be used to drill the holes. The surface is subsequently finished to provide a smooth surface and maintain efficient flow over the aerofoil.

The described PSE system has been improved upon with the use of adaptive machining. Using adaptive machining process, apogee thickness, which by casting capability alone is limited to the order of 0.6 mm nominal can be reduced. The thickness of the apogee need only then be limited to reduce handling damage with thickness of around 0.2-0.5 mm nominal achieveable. Adaptive machining of the trailing edge is conventionally undertaken prior to drilling of cooling holes. However this does not improve the EDM capability as the drilled holes must be positioned away from the apogee to reduce variation due to the uneven surface. Also the shallow entry angle of an EDM tool increases scarring of the drilled surface of the aerofoil.

U.S. patent publication no. US8770920B2 discloses an arrangement wherein a step is cut into the apogee of a trailing edge. This allows for holes to be drilled through a thicker section of the aerofoil, upstream of the apogee. The step also results in a reduced thickness at the apogee. A scalloped surface extends forward of the step to the apogee. The presence of this step on the pressure or surface side of the aerofoil can have a detrimental effect on flow as it passes the trailing edge.

SUMMARY

The present disclosure provides an aerofoil having a leading edge and a trailing edge, the leading edge and trailing edge connected by a pressure surface side and a suction surface side and one or more cavities bounded by the pressure surface side and/or suction surface side and arranged, in use, to receive coolant from a coolant source, the trailing edge having an apogee where the pressure surface side and suction surface side meet and wherein a row of holes is provided to a pressure surface side or a suction surface side of a centreline of the apogee, the holes in fluid communication with one or more of the cavities, the arrangement being such that outlets to the holes extend from the apogee and onto an adjacent part of the pressure surface side or suction surface side.

The row of holes may extend along part of or substantially the entire apogee. The holes may be equally spaced. Alternatively, the holes may be unequally spaced, for example in a repeating pattern. The holes may be grouped into smaller numbers with larger spaces between groups. The holes may have a diameter in the order of 0.3 to 0.6 mm, for example 0.3 to 0.5 The apogee may have a thickness in the order of 0.2 to 0.5 mm. For example around 0.3-0.45 mm.

An aerofoil in accordance with the disclosure can be manufactured by casting an aerofoil using known investment casting processes. Alternative methods will no doubt occur to the skilled reader and include additive manufacturing techniques such as (without limitation) direct laser deposition (DLD). EDM (or alternative drilling methods) may then be used to introduce the holes at the apogee to a pressure surface side or suction surface side of a centre line of the apogee. An advantage of this is that the holes may be drilled orthogonally to a planar surface of the apogee. In contrast to the prior known methods, adaptive machining can be applied to thin the apogee of the trailing edge on the side into which the holes are provided whilst maintaining a smooth aerodynamic surface along the pressure surface side. As a final step the machined surface may be finished with a finishing operation. Finishing operations may be selected from (without limitation); polishing, buffing, blasting or burnishing.

A benefit of the proposed method and arrangement is that cooling holes can be made longer compared to prior art arrangements and have a larger surface area resulting in improved cooling effectiveness at the trailing edge. Since holes can be drilled normal to the apogee surface (rather than into the inclined/curved pressure surface) machining yields may be improved by consequent reductions in scarring, burning and positional variation. Positioning of the holes along the apogee of the trailing edge is expected to provide an aerodynamic benefit as the coolant is partially ejected into the trailing edge wake zone.

Alternative drilling methods may be used in the drilling step; for example these may include; laser drilling, STEM drilling and manual drilling.

The holes may be drilled with any of a range of cross sectional shapes. For example, but without limitation, the cross-sectional shape may be selected from: circular, racetrack, elliptical or rectangular. The holes may be provided with a uniform cross section along their length. Alternatively, the holes may be fanned in cross section along their centre axis.

BRIEF DESCRIPTION OF DRAWINGS

Some embodiments of the disclosure will now be further described with reference to the accompanying Figures in which.

DETAILED DESCRIPTION OF DRAWINGS AND EMBODIMENTS

Figure 1:
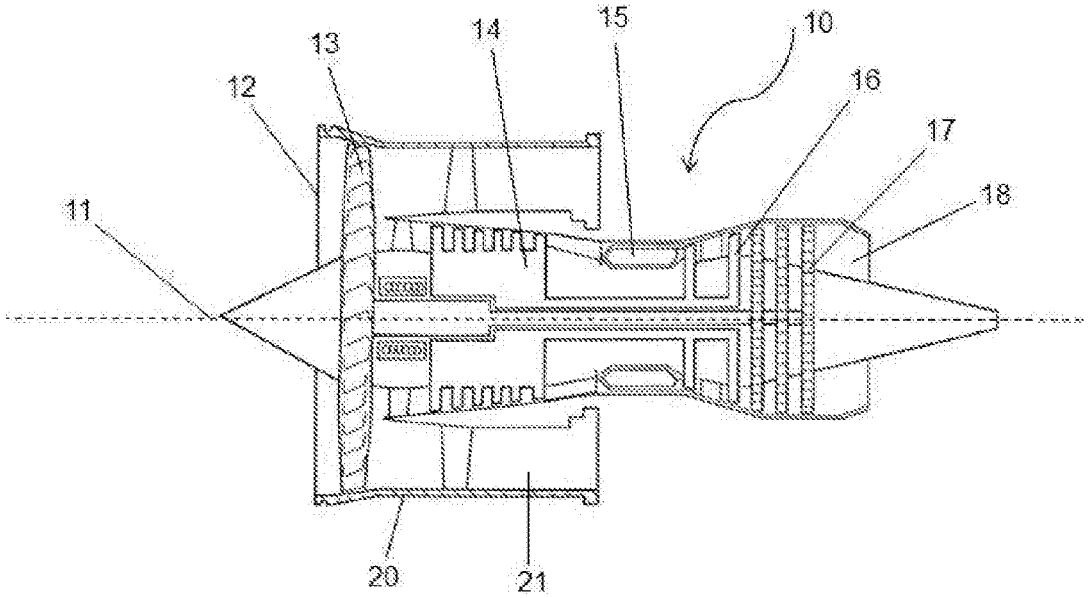
FIG. 1 (PRIOR ART)
FIG. 1 is a sectional side view of a known gas turbine engine into which aerofoils of the disclosure might usefully be employed.

With reference to FIG. 1, a gas turbine engine is generally indicated at 10, having a principal and rotational axis 11. The engine 10 comprises, in axial flow series, an air intake 12, a propulsive fan 13, a high-pressure compressor 14, combustion equipment 15, a high-pressure turbine 16, a low-pressure turbine 17 and an exhaust nozzle 18. A nacelle 20 generally surrounds the engine 10 and defines the intake 12.

The gas turbine engine 10 works in the conventional manner so that air entering the intake 12 is accelerated by the fan 13 to produce two air flows: a first air flow into the high-pressure compressor 14 and a second air flow which passes through a bypass duct 21 to provide propulsive thrust. The high-pressure compressor 14 compresses the air flow directed into it before delivering that air to the combustion equipment 15.

In the combustion equipment 15 the air flow is mixed with fuel and the mixture combusted. The resultant hot combustion products then expand through, and thereby drive the high and low-pressure turbines 16, 17 before being exhausted through the nozzle 18 to provide additional propulsive thrust. The high 16 and low 17 pressure turbines drive respectively the high pressure compressor 14 and the fan 13, each by suitable interconnecting shaft.

Aerofoils in accordance with the disclosure may usefully be applied in, for example, the turbines 16 and 17 of the described gas turbine engine.

Figure 2:
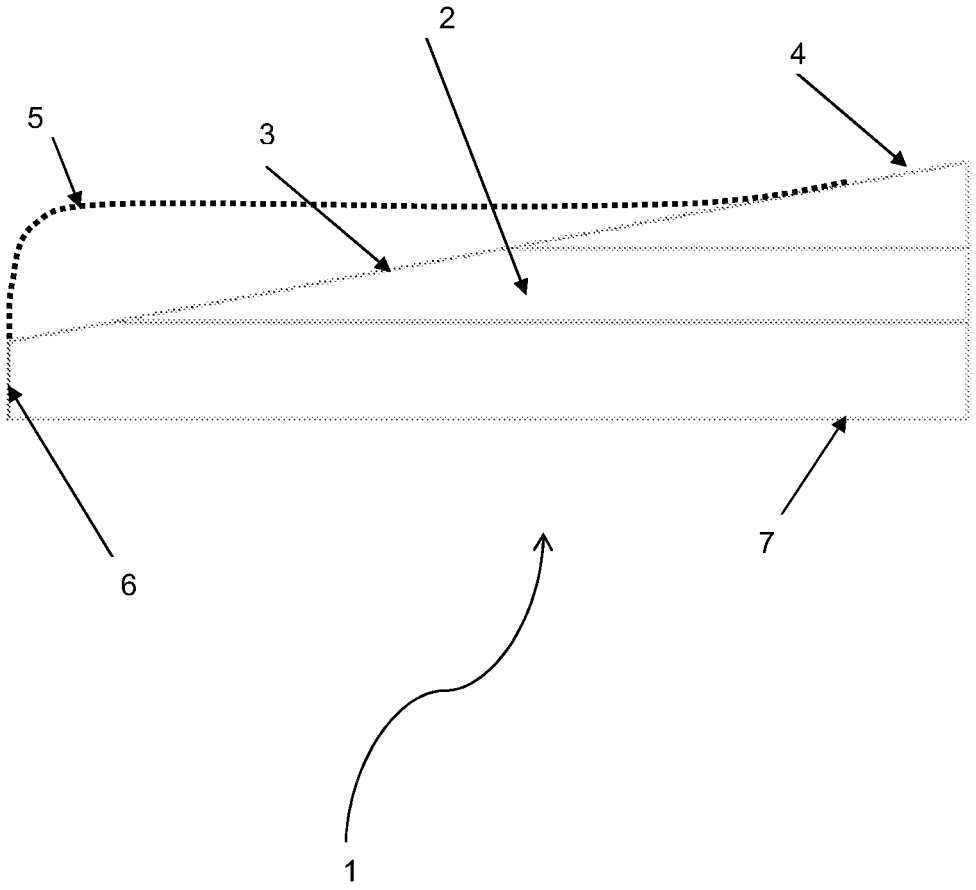
Fig. 2 (PRIOR ART)
FIG. 2 is a sectional view through a trailing edge of a prior known turbine blade design illustrating material removed from the cast blade prior to machining of cooling holes into the trailing edge.

FIG. 2 shows a trailing edge 1 of a turbine blade known from the prior art. The trailing edge 1 has cooling holes 2 which have an outlet 3 arranged in a pressure surface side 4 of the trailing edge 1. The dotted outline 5 represents the outline of a casting from which the trailing edge 1 is machined. The outlined section 5 is removed from the casting prior to the holes 2 being drilled into the trailing edge from the pressure side surface 4. The trailing edge has an apogee 6 whose thickness is reduced when the outlined section 5 is removed. The apogee 6 is defined by the meeting of the pressure surface side 4 and suction surface side 7.

Figure 3:
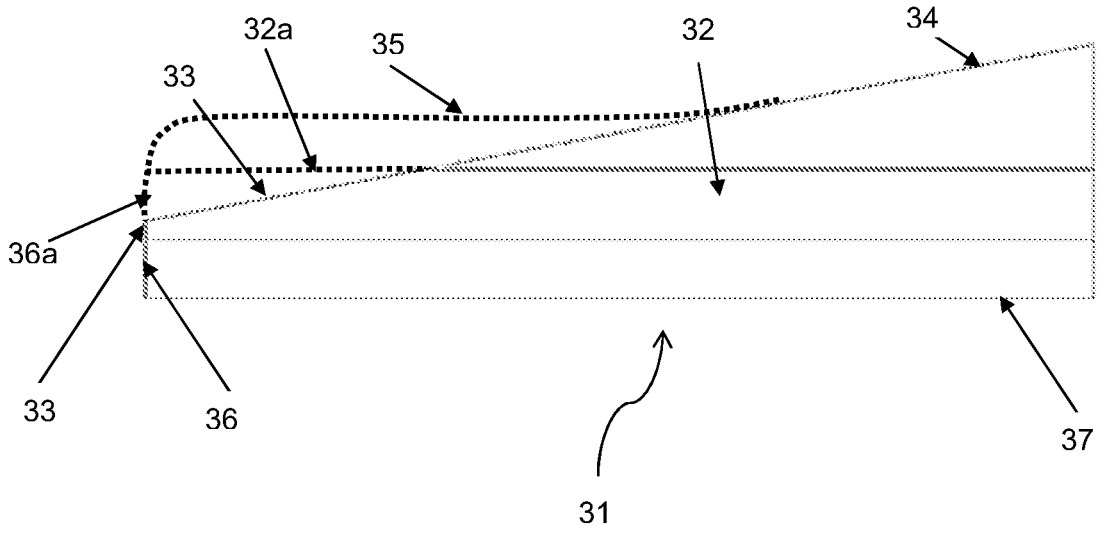
FIG. 3 is a sectional view through a trailing edge of a turbine blade design in accordance with an embodiment of the disclosure illustrating material removed from the cast blade after machining of cooling holes into the trailing edge.

FIG. 3 shows a trailing edge 31 of a turbine blade in accordance with an embodiment of the disclosure. The trailing edge 31 has a pressure surface side 34, and a suction surface side 37 which meet to define an apogee 36. A cooling hole 32 has an outlet 33 which extends both in to the apogee 36 and the pressure surface side 34. The outlined section 35 is removed from the casting after the holes 32 have been drilled into trailing edge from the apogee side 36*a*. As can be seen, in contrast to the prior art shown in FIG. 2, this permits the line of drilling to be perpendicular to the apogee surface 36*a*. Dotted line 32*a* represents a wall portion of the hole 32 which is subsequently removed during the machining operation.

Figure 4:
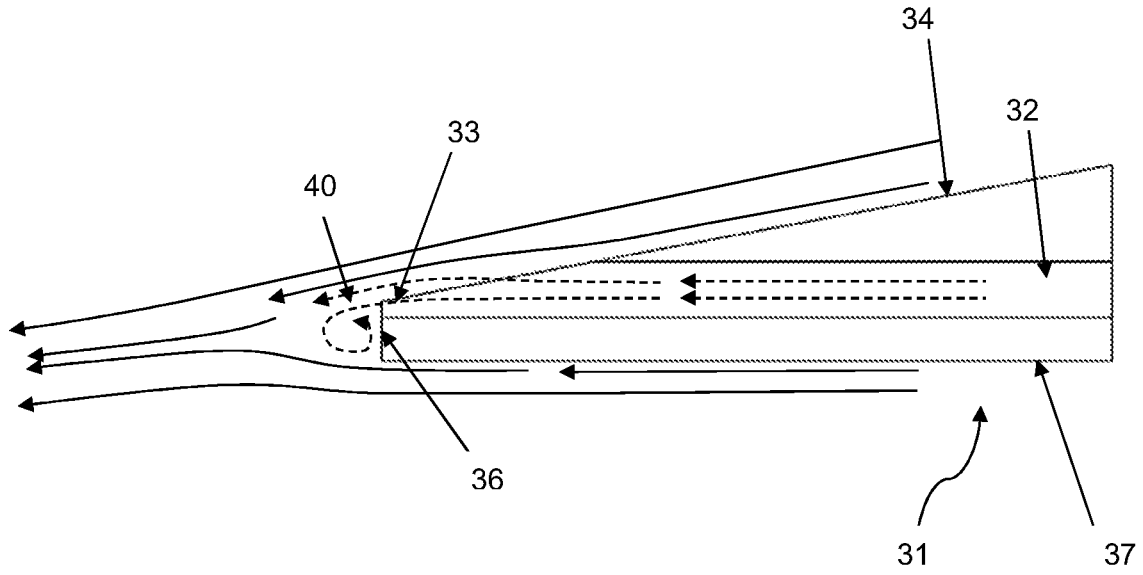
FIG. 4 is a schematic showing air flow through and around the trailing edge of FIG. 3.

FIG. 4 illustrates air flow in the trailing edge 31 of FIG. 4. The dotted line arrows represent cooling air passing from a cavity within the blade (not shown) and through the trailing edge 31 through cooling hole 32. The solid line arrows represent working fluid flow over the blade. As can be seen cooling air 40 exiting outlet 33 in the apogee 36 fills a void between streams of work fluid passing over the apogee 36 from the pressure surface side 34 and the suction surface side 37. Aerodynamic performance is expected to be improved as aerofoil wake loss is reduced due to this filing of the void.

Figure 5:
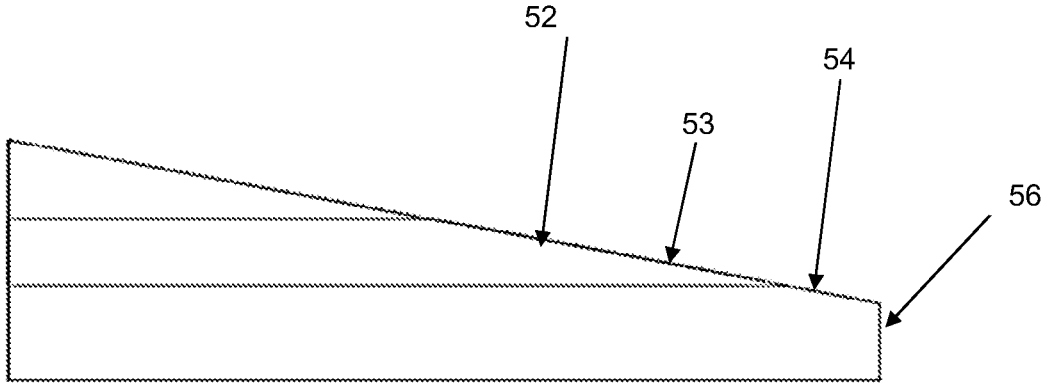
Fig. 5 (PRIOR ART)
FIG. 5 is a sectional view through a trailing edge of a prior known turbine blade after machining.
Figure 6:
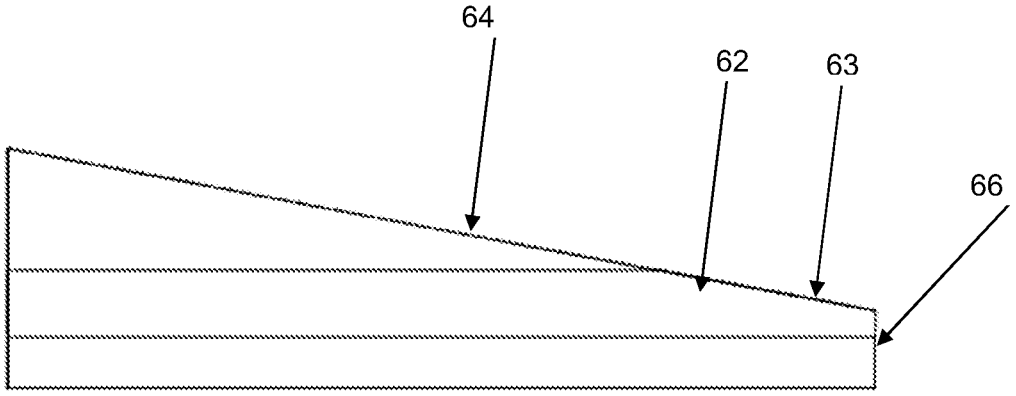
FIG. 6 is a sectional view through a trailing edge of a turbine blade in accordance with the disclosure after machining.

FIGS. 5 and 6 show comparable sections of a prior art trailing edge and a trailing edge in accordance with an embodiment of the disclosure. As can be seen, each arrangement has a hole 52, 62 extending through the trailing edge on a pressure surface side 54, 64 of an apogee 56, 66. In the arrangement in accordance with the disclosure, the outlet of the hole 62 extends across part of the apogee 66 and the pressure surface side 64. In the prior art arrangement of FIG. 5, the outlet is present only in the pressure surface side 54.

Figure 7:
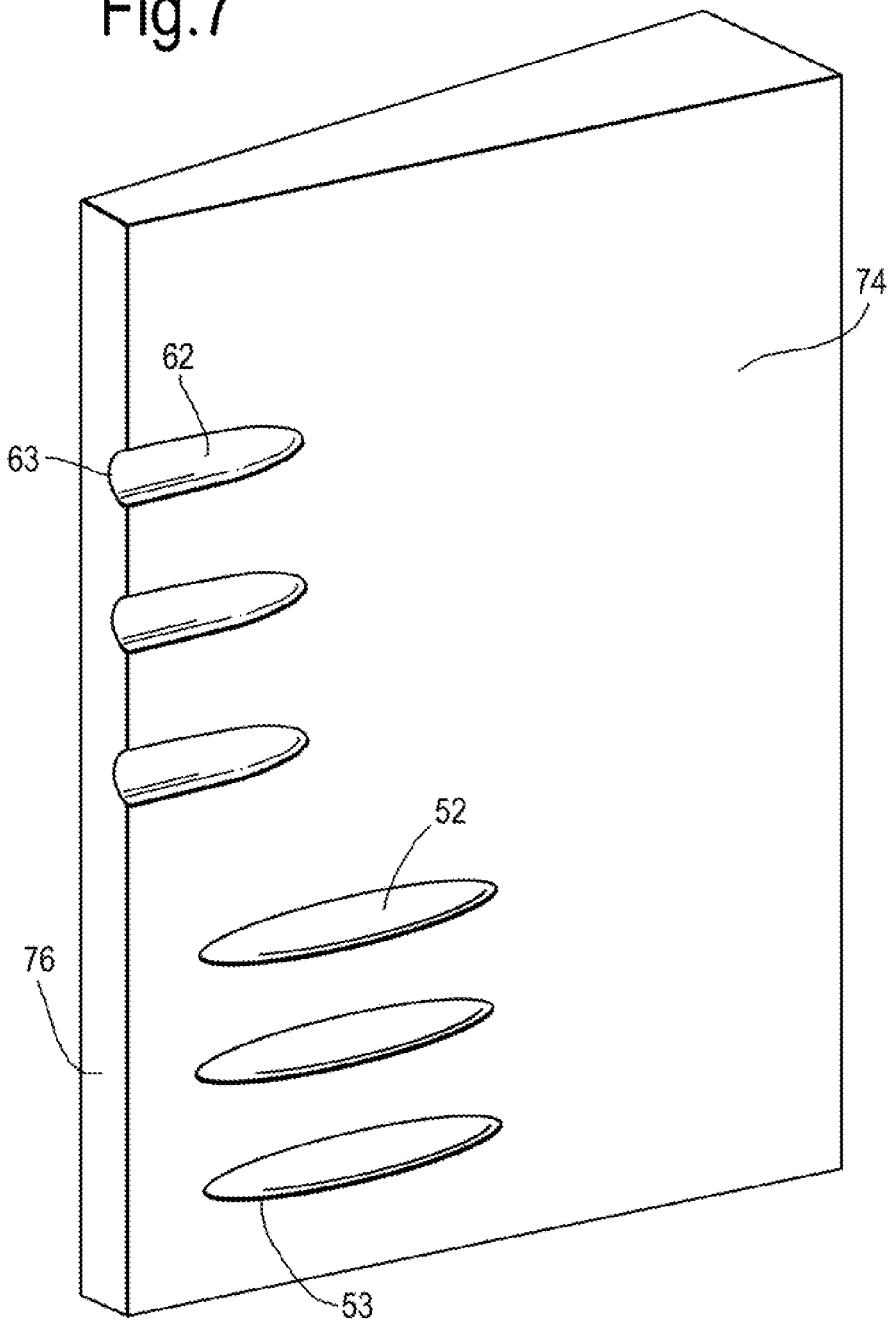
FIG. 7 is a perspective view of a trailing edge bearing one row of cooling holes provided in accordance with the prior art and a second row of cooling holes provided in accordance with an embodiment of the disclosure.

FIG. 7 shows a perspective view of the holes of FIGS. 5 and 6 which shows the apogee 76 and pressure surface side 74 of a trailing edge bearing the holes 53, 63. This more clearly illustrates the positioning of the outlets 53 and 63.

Figure 8:
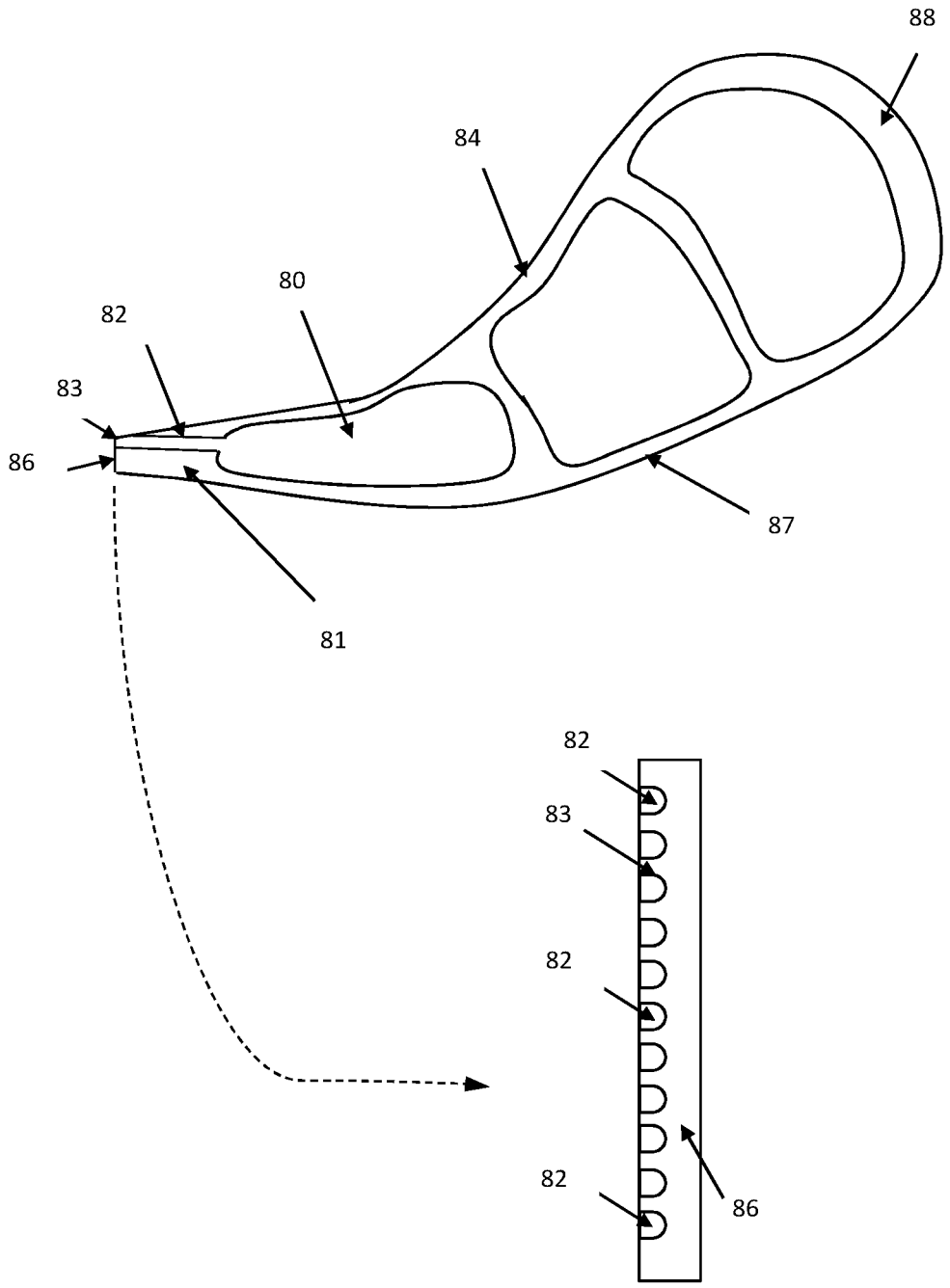
FIG. 8 shows a cross section of an aerofoil in accordance with an embodiment of the disclosure.

As can be seen, the aerofoil of FIG. 8 has a leading edge 88, and a trailing edge 81. A pressure surface side wall 84 and a suctions surface side wall 87 extend between the leading edge 88 and trailing edge 81. The walls 84, 87 enclose cavities including trailing edge cavity 80. A cooling hole 82 extends from the cavity 80 to an apogee 86 of the trailing edge 81. The outlet 83 to the hole 82 extends into both the pressure surface side wall 84 and the apogee 86.

When in operation in a gas turbine engine, coolant is delivered into the cavity 80 and directed out through a row of holes 83 extending along the apogee 86 (as shown in the end view of the figure). For example, the coolant may be derived from compressed air which has by-passed the combustor in the engine and is distributed though channels beneath the root of a turbine blade comprising the aerofoil. Rotation in the system generates a radial pressure gradient encouraging flow into the cavities including trailing edge cavity 80 of the aerofoil from which the coolant exits through the holes 82 by outlets 83. On alternative arrangement other sources of coolant may be used and different delivery routes for supplying coolant into the cavity 80 may also be used.

The invention claimed is:

1. An aerofoil comprising:

a leading edge and a trailing edge, the leading edge and the trailing edge connected by a pressure surface side and a suction surface side, and one or more cavities bounded by at least one of the pressure surface side or the suction surface side and arranged, in use, to receive coolant from a coolant source, wherein:

the trailing edge has an apogee where the pressure surface side and the suction surface side meet, the apogee has a thickness between the pressure surface side and the suction surface side, a row of holes, orthogonal to the apogee, is provided with the centres of the holes arranged closer to one of a pressure surface side or a suction surface side relative to a centreline of the apogee, the holes are in fluid communication with one or more of the cavities, a part of each of the outlets to the holes is in the apogee such that a thickness of the apogee changes from a first end of the trailing edge to a second end of the trailing edge opposite the first end, and a remainder of each of the outlets is in an adjacent part of the one of the pressure surface side or the suction surface side.

2. The aerofoil as claimed in claim 1, wherein the row of holes extends along the entire apogee.

3. The aerofoil as claimed in claim 1, wherein the row comprises equally spaced holes.

4. The aerofoil as claimed in claim 1, wherein the row comprises unequally spaced holes.

5. The aerofoil as claimed in claim 1, wherein the holes of the row are grouped with larger spaces between grouped holes.

6. The aerofoil as claimed in claim 1, wherein the holes have a diameter of from 0.3 to 0.6 mm.

7. The aerofoil as claimed in claim 1, wherein the thickness of the apogee is from 0.2 to 0.5 mm.

8. The aerofoil as claimed in claim 1, wherein the cross sectional shape of the holes is selected from; circular, racetrack, elliptical or rectangular.

9. The aerofoil as claimed in claim 1, wherein one or more holes are fanned along a centreline of the hole.

10. A method for manufacturing an aerofoil comprising:

manufacturing a blade body having a leading edge and a trailing edge, pressure surface side and a suction surface side and a cavity bounded by at least one of the pressure surface side or the suction surface side and the trailing edge;

in an apogee of the trailing edge, the apogee having a thickness between the pressure surface side and the suction surface side, drilling holes having their centres arranged to the pressure surface side or the suction surface side of a centreline of the apogee, the holes extending orthogonally to the apogee and into the cavity;

after drilling the holes, machine the trailing edge on the pressure surface side or the suction surface side so as to thin the apogee on the side to which the holes are drilled whilst retaining a part of the outlet of the holes in the apogee such that a thickness of the apogee changes from a first end of the trailing edge to a second end of the trailing edge opposite the first end.

11. The method as claimed in claim 10, wherein the step of drilling the holes involves EDM.

12. The method as claimed in claim 10, wherein the step of drilling involves a method selected from; laser drilling, STEM drilling or manual drilling.

13. The method as claimed in claim 10, wherein the step of machining involves an adaptive machining process.

14. The method as claimed in claim 10, further comprising performing a surface finishing operation to the machined surface.

15. The method as claimed in claim 10, wherein the step of machining the trailing edge results in an the thickness of the apogee being from 0.2 to 0.5 mm.

16. The method as claimed in claim 10, wherein the holes are drilled with a diameter of from 0.3 to 0.6 mm.

* * * * *